US009285748B2

(12) United States Patent
Oida

(10) Patent No.: US 9,285,748 B2
(45) **Date of Patent: *Mar. 15, 2016**

(54) IMAGE FORMING APPARATUS

(71) Applicant: Takashi Oida, Osaka (JP)

(72) Inventor: Takashi Oida, Osaka (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/615,019

(22) Filed: Feb. 5, 2015

(65) Prior Publication Data

US 2015/0147076 A1 May 28, 2015

Related U.S. Application Data

(63) Continuation of application No. 14/162,884, filed on Jan. 24, 2014, now Pat. No. 8,983,312.

(30) Foreign Application Priority Data

Feb. 12, 2013 (JP) ..... 2013-024905

(51) Int. Cl.
*G03G 15/00* (2006.01)

(52) U.S. Cl.
CPC ..... *G03G 15/556* (2013.01)

(58) Field of Classification Search
CPC ..... G03G 15/0831; G03G 15/556; G03G 2215/0894
See application file for complete search history.

(56) References Cited

U.S. PATENT DOCUMENTS 4,934,314 A 6/1990 Ideyama
8,577,231 B2 11/2013 Oh
8,983,312 B2 * 3/2015 Oida ..... 399/27

FOREIGN PATENT DOCUMENTS

JP 2007233091 A 9/2007
JP 2008009055 A 1/2008

* cited by examiner

*Primary Examiner* — Gregory H Curran
(74) *Attorney, Agent, or Firm* — Harness, Dickey & Pierce, P.L.C.

(57) ABSTRACT

An image forming apparatus includes a toner container; a developing unit; a detection unit detecting toner in the developing unit; a measurement unit measuring as to whether there is a full amount of toner or no toner in the developing unit by using a detection history of the detection unit with regard to the toner; a supplying unit supplying the toner from the toner container to the developing unit; a toner-amount calculation unit calculating, using image data to be printed, an amount of toner consumption needed during printing; an accumulation unit calculating an accumulated amount of toner consumption by accumulating the amount of toner consumption every time printing is conducted; and a fault determination unit determining, using the accumulated amount of toner consumption, whether a measurement result by the measurement unit is normal or not as to whether there is a full amount of toner or no toner.

6 Claims, 11 Drawing Sheets

RELATION BETWEEN TONER-AMOUNT DETECTION RESULT AND COUNT OF TONER CONSUMPTION BETWEEN SUPPLY OPERATIONS

FIG.10

<BEFORE FORCIBLE SUPPLY>

| LIGHT EMITTING/ RECEIVING UNIT | DEVELOPING UNIT | | TONER CONTAINER | | DESIRED OPERATION OF APPARATUS |
|---|---|---|---|---|---|
| | TONER IS PRESENT | TONER IS NOT PRESENT | TONER IS PRESENT | TONER IS NOT PRESENT | |
| NORMAL | ● | | ● | | → CONTINUE |
| | ● | | | ● | → CONTINUE |
| | | ● | ● | | → CONTINUE ※52a |
| | | ● | | ● | →STOP (TONER END) ※53a |
| FAULTY | ● | | ● | | →STOP (SENSOR FAULTY) ※54a |
| | ● | | | ● | →STOP (TONER END) ※55a |
| | | ● | ● | | →STOP (SENSOR FAULTY) ※56a |
| | | ● | | ● | →STOP (TONER END) ※57a |

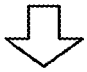

<AFTER FORCIBLE SUPPLY>

| LIGHT EMITTING/ RECEIVING UNIT | DEVELOPING UNIT | | TONER CONTAINER | | DESIRED OPERATION OF APPARATUS |
|---|---|---|---|---|---|
| | TONER IS PRESENT | TONER IS NOT PRESENT | TONER IS PRESENT | TONER IS NOT PRESENT | |
| NORMAL | ● | | ● | | → CONTINUE |
| | ● | | | ● | → CONTINUE |
| | ● | | ● | | → CONTINUE ※52b |
| | | ● | | ● | →STOP (TONER END) ※53b |
| FAULTY | ● | | ● | | →STOP (SENSOR FAULTY) ※54b |
| | ● | | | ● | →STOP (TONER END) ※55b |
| | ● | | ● | | →STOP (SENSOR FAULTY) ※56b |
| | | ● | | ● | →STOP (TONER END) ※57b |

RELATION BETWEEN OPERATING LIFE OF TONER CONTAINER AND ACCUMULATED VALUE OF TONER CONSUMPTION

IMAGE FORMING APPARATUS

CROSS-REFERENCE TO RELATED APPLICATIONS

The present application is a continuation of U.S. application Ser. No. 14/162,884, filed on Jan. 24, 2014, which claims priority to Japanese Patent Application No. 2013-024905, filed in Japan on Feb. 12, 2013, the entire contents of which are hereby incorporated by reference.

BACKGROUND OF THE INVENTION

1. Field of the Invention

The present invention relates to an image forming apparatus.

2. Description of the Related Art

There is a conventionally-known technology for automatically supplying toner from a toner container to a developing unit in an electrophotographic image forming apparatus. In order to make the developing unit stable during toner supply, there is a need to perform control on supply, i.e., the amount of residual toner in the developing unit is detected with as high accuracy as possible, and supplementary toner is supplied gradually, whereby the ratio of the residual toner to the supplementary toner is maintained constant just after the toner is supplied. For example, Japanese Patent Application Laid-open No. 2007-233091 discloses a technology for detecting the amount of residual toner, i.e., a technology of using an optical detection unit installed in a developing unit.

However, in conventional image forming apparatuses that use an optical toner detection unit, it is determined that "toner is not present" when light is transmitted, and it is determined that "toner is present" when light is not transmitted; therefore, if a light emitting/receiving element has an operation failure, connection failure, or optical path misalignment, it is determined that there is a sufficient amount of toner in the developing unit. As a result, it is difficult to determine whether there is actually a full amount of toner or a full amount of toner is falsely detected due to a failure of the detection unit. If a full amount of toner is falsely detected, the amount of toner in the developing unit is undetermined.

If there is no toner in the developing unit, and if printing is continuously performed, developing rollers and photosensitive elements may be damaged; therefore, if the amount of toner in the developing unit is not properly determined, the apparatus needs to be forcibly stopped regardless of whether the full amount of toner is detected or the full amount of toner is falsely detected. Hence, a method is implemented to prevent the apparatus from being forcibly stopped when the full amount of toner is normally detected, that is, the supply amount is controlled so as to prevent the toner from filling the developing unit; however, the amount of toner to be supplied from the toner container per unit time varies widely, and it is difficult to control the amount of toner in the developing unit so as to always prevent a full amount of toner. Thus, there is a problem in that the apparatus is forcibly stopped each time there is a full amount of toner in the developing unit.

In consideration of the foregoing, there is need to provide an image forming apparatus that is capable of preventing false detection as to whether there is a full amount of toner in the developing unit.

SUMMARY OF THE INVENTION

It is an object of the present invention to at least partially solve the problems in the conventional technology.

According to the present invention, there is provided: an image forming apparatus comprising: a toner container configured to be used for development; a developing unit configured to form an image; a detection unit configured to detect toner in the developing unit; a measurement unit configured to make a measurement as to whether there is a full amount of toner or there is no toner in the developing unit by using a detection history of the detection unit with regard to the toner; a supplying unit configured to supply the toner from the toner container to the developing unit; a toner-amount calculation unit configured to calculate, using image data to be printed, an amount of toner consumption that is needed during printing; an accumulation unit configured to calculate an accumulated amount of toner consumption by accumulating the amount of toner consumption every time printing is conducted; and a fault determination unit configured to determine, based on the accumulated amount of toner consumption, whether a measurement result obtained by the measurement unit is normal or not as to whether there is a full amount of toner or there is no toner.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 10 is a table that illustrates the presence or absence of toner in the developing unit and the toner container according to the embodiment;

DETAILED DESCRIPTION OF THE PREFERRED EMBODIMENTS

Figure 1:
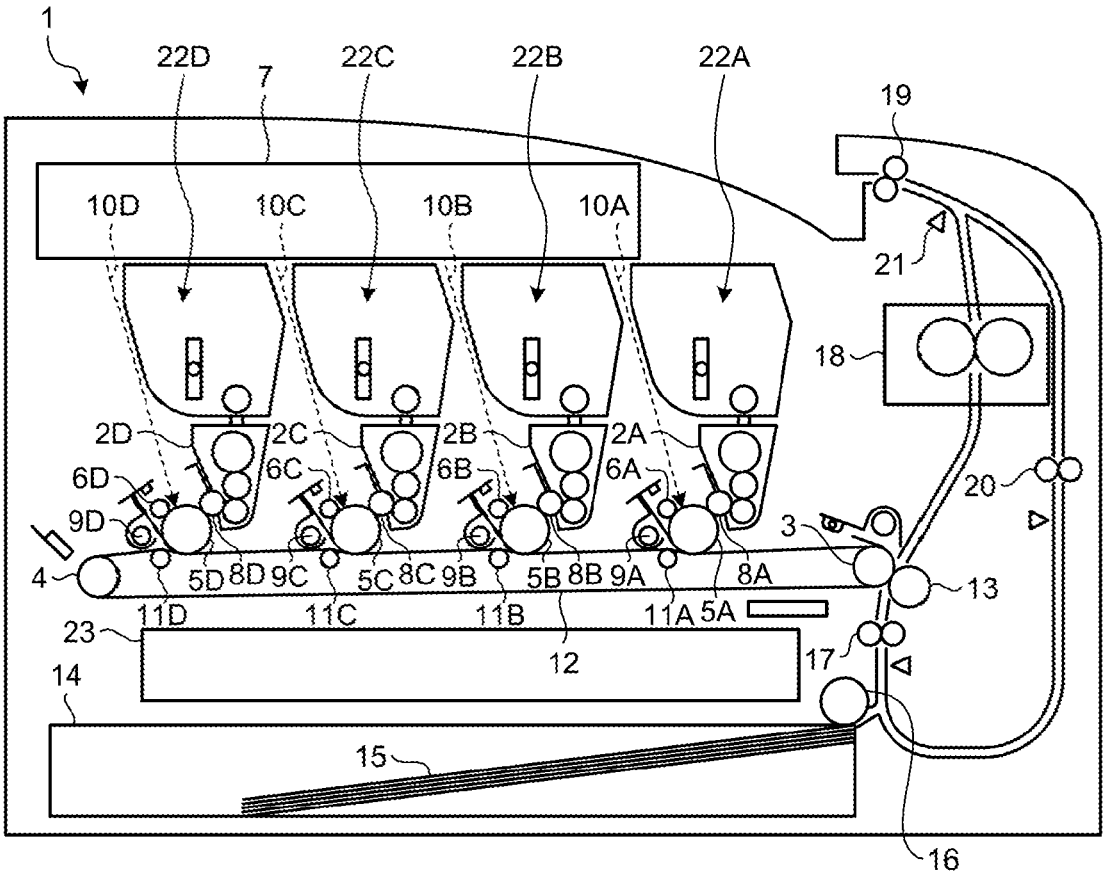
FIG. 1 is a diagram that illustrates the overall configuration of an image forming apparatus according to an embodiment.

Exemplary embodiments of the present invention are explained in detail below with reference to the accompanying drawings. As illustrated in FIG. 1, in an image forming apparatus 1, developing units 2A, 2B, 2C, and 2D of different colors and toner containers 22A, 22B, 22C, and 22D are located side by side along a transfer belt 12. The transfer belt 12 is an endless belt that is wrapped around a secondary transfer drive roller 3 that is driven so as to rotate and a transfer-belt tension roller 4.

The developing unit 2A includes a photosensitive element 5A, a charge device 6A that is located around the photosensitive element 5A, a developing device 8A, and a cleaner blade 9A. An exposure unit 7 emits light beam to the developing unit 2A. The developing units 2A, 2B, 2C, and 2D have the identical internal configuration except that toner images of different colors are formed thereby; therefore, explanations of the developing units 2B, 2C, and 2D are omitted. The exposure unit 7 emits laser lights 10A, 10B, 10C, and 10D that are exposure lights corresponding to the colors of images formed by the developing units 2A, 2B, 2C, and 2D. Furthermore, the exposure unit 7 may be replaced with a line head, such as LEDA.

The image forming apparatus 1 further includes a sheet feeding tray 14 on which sheets 15 are stacked; a sheet feeding roller 16 that conveys the sheet 15; registration rollers 17; discharge rollers 19; two-sided rollers 20; a secondary transfer roller 13 that transfers the image formed on the transfer belt 12 to a sheet; and a fixing device 18 that fixes the transferred toner to the sheet 15. A discharge sensor 21 that detects the passage of the sheet 15 is located near the discharge rollers 19. Furthermore, a waste-toner box 23 is provided in the image forming apparatus 1 so as to collect the pattern formed on the transfer belt 12 and the residual toner that has not been transferred onto the sheet 15.

Next, an explanation is given of a typical operation of the image forming apparatus 1 that is configured as above. During image formation, after the outer circumference of the photosensitive element 5A is uniformly charged by the charge device 6A in darkness, the outer circumference of the photosensitive element 5A is irradiated with the laser light 10A from the exposure unit 7, whereby an electrostatic latent image is formed. The developing device 8A develops the electrostatic latent image by using toner so that a toner image is formed on the photosensitive element 5A. The toner image is transferred onto the transfer belt 12 due to an operation of a primary transfer roller 11A at the position (the primary transfer position) where the photosensitive element 5A is in contact with the transfer belt 12, whereby a toner image is formed on the transfer belt 12. After the transfer of the toner image is completed, the unnecessary toner that remains on the outer circumference of the photosensitive element 5A is removed by the cleaner blade 9A, and then the photosensitive element 5A stands by for the next image formation.

As described above, after the toner image is transferred onto the transfer belt 12 by the developing unit 2A, the transfer belt 12 is moved to the next developing unit 2B. During the same image formation process as that performed by the developing unit 2A, the image is transferred by the developing unit 2B such that it is superimposed on the image formed on the transfer belt 12. The transfer belt 12 is further moved to the next developing units 2C and 2D, and the images are transferred onto the transfer belt 12 in a superimposed manner during the same operation. Thus, a full-color image is formed on the transfer belt 12. The transfer belt 12 on which the superimposed full-color image is formed is moved to the position of the secondary transfer roller 13.

During a sheet conveying operation for image formation, the sheets 15 contained in the sheet feeding tray 14 are sequentially delivered, starting from the uppermost sheet 15, when the sheet feeding roller 16 is driven so as to rotate in a counterclockwise direction. The registration rollers 17 start to be driven at timing such that the position of the toner image that is conveyed by the transfer belt 12 and the position of the sheet 15 are overlapped with each other on the secondary transfer roller 13. At that time, the registration rollers 17 are driven so as to rotate in a counterclockwise direction, thereby delivering the sheet 15. After the toner image on the transfer belt 12 is transferred by the secondary transfer roller 13 onto the sheet 15 delivered by the registration rollers 17, the toner image is fixed due to heat and pressure by the fixing device 18, and then the sheet 15 is discharged from the image forming apparatus 1 by the discharge rollers 19 that are driven so as to rotate in a clockwise direction.

If two-sided printing is to be conducted, the discharge rollers 19 are driven so as to rotate in a counterclockwise direction before the sheet 15 passes through the discharge rollers 19, whereby the sheet 15 is conveyed to a two-sided conveyance path. After the sheet 15 is conveyed to the two-sided conveyance path, the sheet 15 is delivered to the registration rollers 17 again through the two-sided rollers 20. After the sheet 15 reaches the registration rollers 17, the sheet 15 is delivered from the registration rollers 17 again. After the toner image is transferred onto the opposite surface of the sheet by the secondary transfer roller 13, the toner image is fixed due to heat and pressure by the fixing device 18, and then the sheet 15 is discharged from the image forming apparatus 1 by the discharge rollers 19 that are driven so as to rotate in a clockwise direction.

Furthermore, a detection sensor (a detection unit) is provided in each of the developing units 2A, 2B, 2C, and 2D to detect whether the amount of toner is equal to or less than a certain amount; thus, the detection sensor detects whether the amount of toner in the developing unit is equal to or less than a certain amount, and toner is supplied from the toner containers 22A, 22B, 22C, and 22D to the developing units 2A, 2B, 2C, and 2D.

Figure 2:
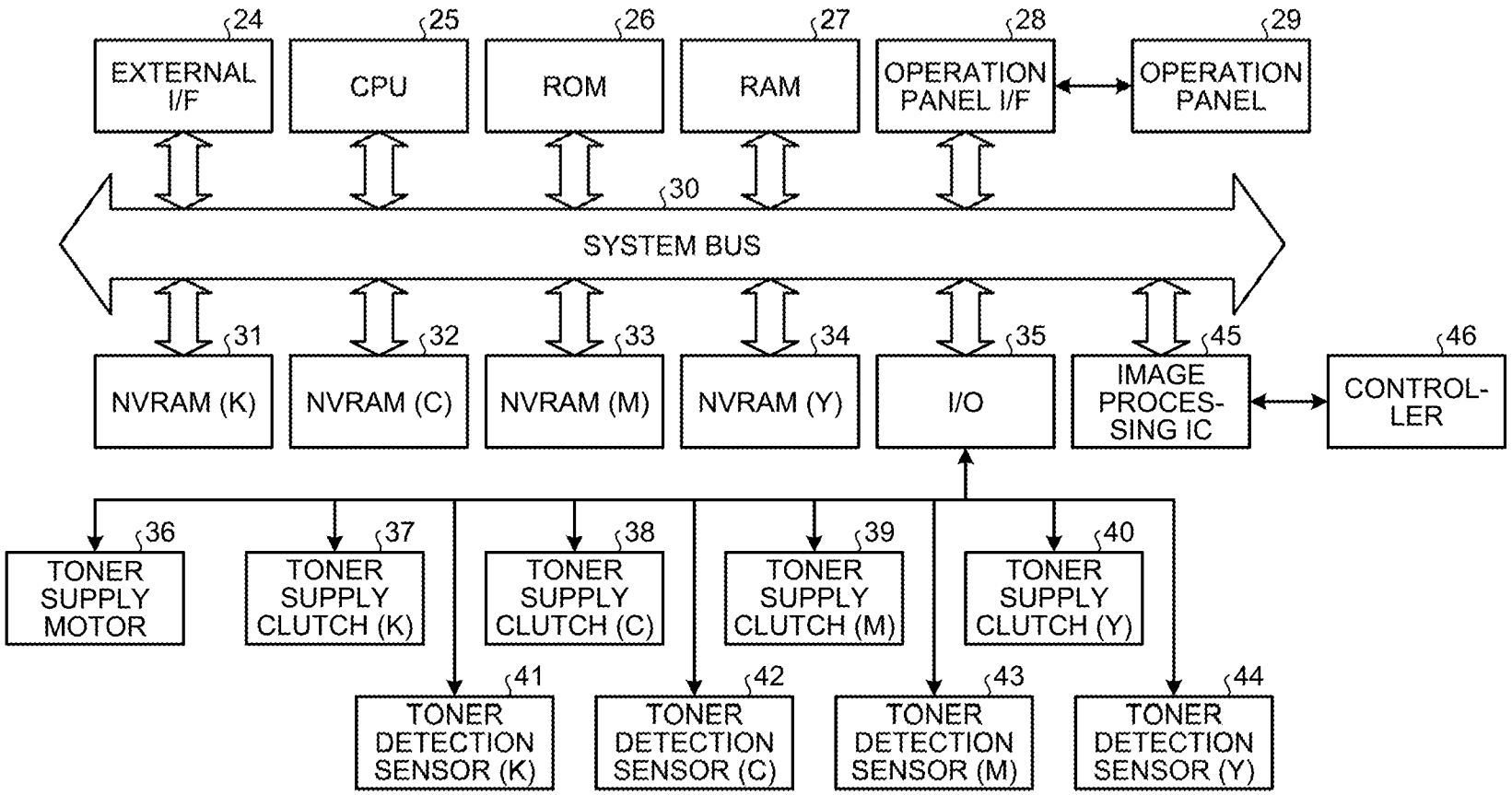
FIG. 2 is a block diagram that illustrates hardware of the image forming apparatus according to the embodiment.

Next, an explanation is given, with reference to FIG. 2, of a hardware configuration in relation to a control of the image forming apparatus 1. As illustrated in FIG. 2, the image forming apparatus 1 includes an external I/F 24, a CPU 25, a ROM 26, a RAM 27, an operation panel I/F 28, an operation panel 29, an NVRAM(K) 31, an NVRAM(C) 32, an NVRAM(M) 33, an NVRAM(Y) 34, I/O 35, an image processing IC 45, and a controller 46. These units are connected to one another via a system bus 30.

The CPU 25 is an image forming apparatus 1's processor that performs overall control on accesses to various devices connected to the system bus 30 in accordance with a control program, or the like, stored in the ROM 26 and controls inputs and outputs of electric components, such as sensors, motors, clutches, or heaters, that are connected via the I/O 35. Furthermore, the ROM 26 stores control programs for the CPU 25. The CPU 25 executes the control programs stored in the ROM 26 and also performs processing on communication with an external device, such as a host computer, via the external I/F 24.

The RAM 27 is a RAM that serves as a main memory, work area, or the like, of the CPU 25 and is used as a recorded-data loading area, environmental-data storage area, or the like. Each of the NVRAMs 31, 32, 33, and 34 is installed in a corresponding one of the toner containers 22A, 22B, 22C, and 22D so as to store information, such as the amount of toner that remains in the toner container.

The operation panel 29 is connected via the operation panel I/F 28 so as to enable settings, such as a printer mode. A toner supply motor 36 is driven, and each of toner supply clutches 37, 38, 39, and 40 enters the ON state, whereby toner is supplied from each of the toner containers 22A, 22B, 22C, and 22D to a corresponding one of the developing units 2A, 2B, 2C, and 2D. Furthermore, toner detection sensors 41, 42, 43, and 44 are provided in the developing units 2A, 2B, 2C, and 2D so as to detect whether the amount of toner contained is equal to or greater than a certain amount.

The image processing IC 45 receives image data from the controller 46 and sends the image data to the exposure unit 7. Furthermore, the image processing IC 45 calculates the amount of toner consumption on a per-page basis by using the image data received from the controller 46 and then notifies the calculated amount of toner consumption to the CPU 25 via the system bus 30.

Figure 3:
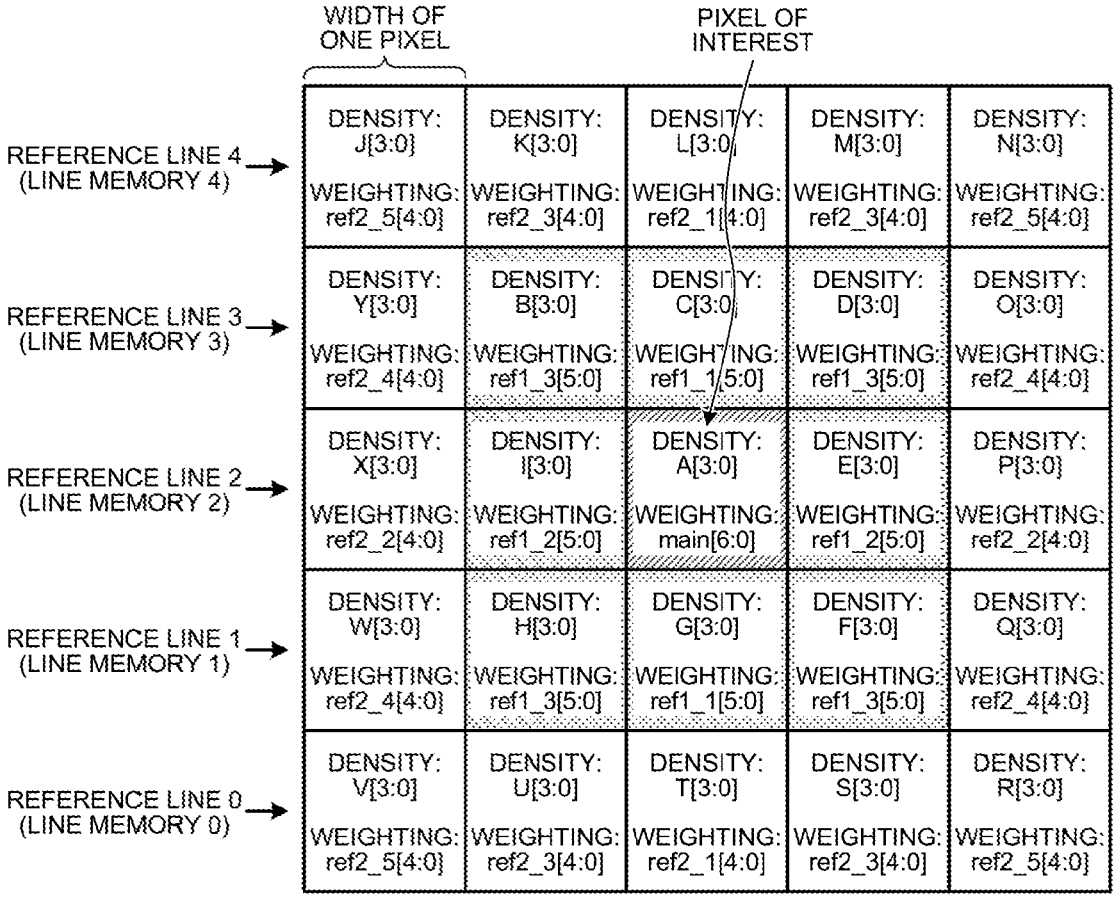
FIG. 3 is a diagram that illustrates a method of calculating an amount of toner consumption according to the embodiment.

FIG. 3 is a diagram that illustrates a method performed by the image processing IC 45 (a toner-amount calculation unit) to calculate an amount of toner consumption. First, the image processing IC 45 extracts the data on 5 pixels in the main-scanning direction and 5 pixels in the sub-scanning direction from the image data read from a line memory and generates 5×5 matrix data with the pixel A of interest at the center. At that time, the image processing IC 45 previously performs γconversion on the density data on each pixel in accordance with the characteristics of the exposure unit 7. The image processing IC 45 sets a weighting coefficient to the pixel A of interest, reference pixels B to I that are adjacent to the pixel A of interest in the vertical, horizontal, and oblique directions, and reference pixels J to Y that are located at a distance corresponding to two pixels, thereby calculating the total amount of light with respect to the pixel A of interest. Here, the amount of light means the value that is calculated with respect to each toner color included in a pixel. Therefore, in the present embodiment, the consumption of each of the four types of toner is calculated with respect to the pixel A of interest on the basis of the amount of light. The same value is used as a weighting coefficient for the reference pixels that have a symmetrical relationship to each other with the pixel of interest interposed therebetween. The equation for calculating the amount of light of the pixel A of interest is as follows, where main is the weighting coefficient of the pixel A of interest and refN is the weighting coefficient of each reference pixel.

Amount of light of the pixel A=A*main+(C+G)*ref1−1+(E+I)*ref1−2+(B+D+F+H)*ref1−3+(L+T)*ref2−1+(P+X)*ref2−2+(K+M+S+U)*ref2−3+(O+Q+W+Y)*ref2−4+(J+N+R+V)*ref2−5

The amount of toner for development is proportional to the amount of light with which a photosensitive element is irradiated; however, it is saturated with a certain amount of light (the upper limit), and no more toner is used for development. Therefore, the image processing IC 45 performs a saturation operation. The saturation operation is represented by using the following equation.

If the amount of light of the pixel A≤the upper limit, the corresponding value (X) of toner consumption=the amount of light of the pixel A.

If the amount of light of the pixel A>the upper limit, the corresponding value (X) of toner consumption=the upper limit.

Furthermore, in order to approximate the corresponding value of the calculated toner consumption to the actual amount of toner for development, the image processing IC 45 subtracts an offset value, i.e., a certain amount, from the amount of light of the pixel A, thereby calculating the corresponding value of the toner consumption per pixel. If the result of subtraction is a minus, the result becomes zero.

The image processing IC 45 performs the above operation on all the pixels within a single page to be printed and calculates the total of toner-consumption corresponding values of the single page. The calculated value of the toner-consumption corresponding values is stored in a corresponding one of the NVRAMs 31, 32, 33, and 34. Moreover, a toner-consumption corresponding value is calculated each time printing is conducted, and the value is added to the previously calculated toner-consumption corresponding value for update. Thus, the image processing IC 45 accumulates the values in the NVRAMs 31, 32, 33, and 34 for update, thereby serving as an accumulation unit. When toner is supplied from the toner containers 22A, 22B, 22C, and 22D to the developing units 2A, 2B, 2C, and 2D and thus it is detected that there is a full amount of toner, the values in the NVRAMs 31, 32, 33, and 34 are reset to "0". If a neighboring pixel is located outside the image area, the neighboring reference pixel is treated as a pixel whose amount of light is 0. The range that is used for the above-described calculation does not need to be 5×5 pixels, and the calculation method may be changed as appropriate.

Furthermore, the image data to be used for consumption calculation is changed depending on the exposure unit 7, whereby the consumption can be calculated with higher accuracy. If a light emitting device is a scanning exposure unit that includes an LD and a rotator, the amount of consumption is calculated by using light emission data, whereby the consumption can be calculated with higher accuracy. Moreover, if a light emitting device is a line-type exposure unit, such as an LEDA, the light emitting elements are unevenly arranged in the line. Therefore, unevenness data is registered in a non-volatile memory provided for the line head, the unevenness data is used to perform skew correction, and then light is emitted. If the data obtained after skew correction is used, an error occurs between the formed image and the image used for consumption calculation; therefore, the consumption is calculated on the basis of the image data obtained before skew correction.

Figure 4:
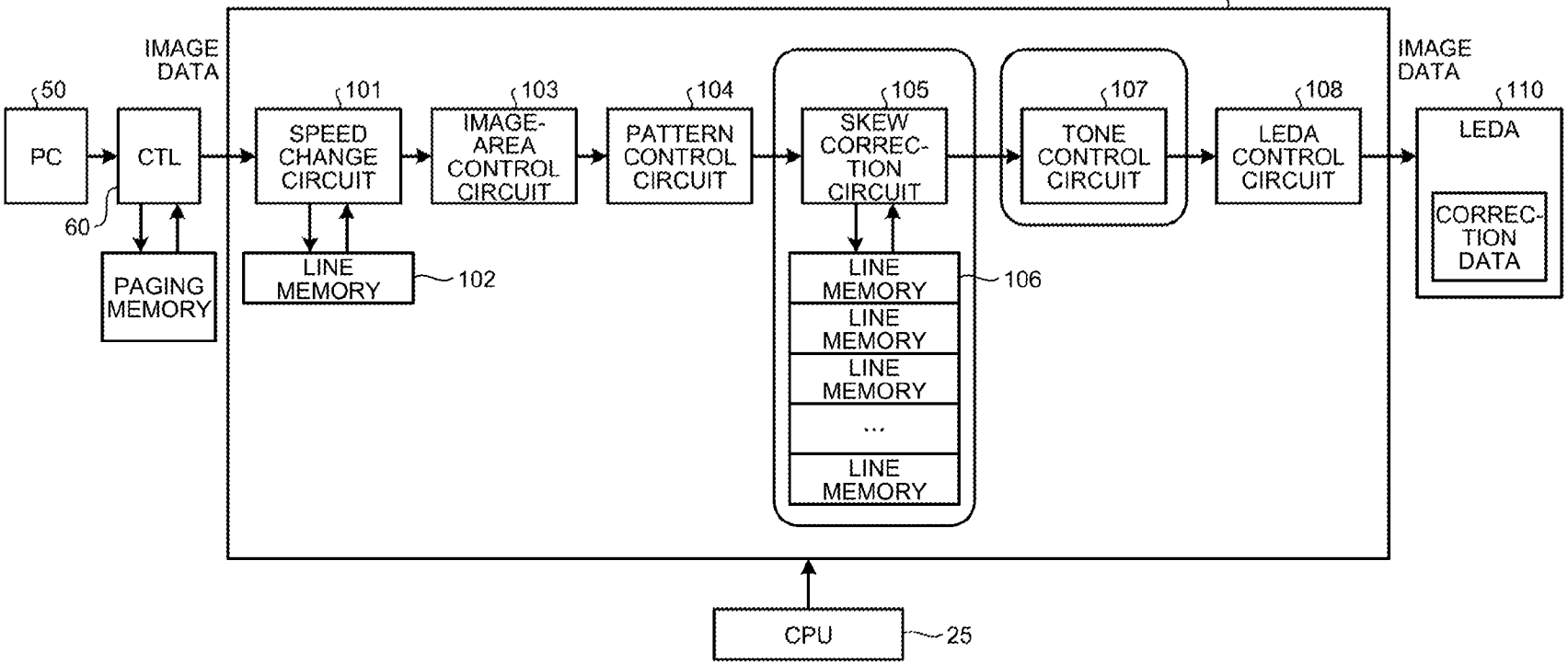
FIG. 4 is a block diagram of a system that controls LEDA writing according to the embodiment.

Here, an explanation is given, with reference to FIG. 4, of the flow of control on the line-type exposure unit to explain the reason why an error occurs with respect to the image data used for consumption calculation before and after skew correction is performed. As illustrated in FIG. 4, when a PC 50 gives an instruction to perform a printing operation, the image data is sent to a controller (CTL) 60 via a printer driver in the PC 50. The CTL 60 stores the image data in the paging memory, converts it into a bitmap data, and sends it as light emission data for actual printing to an LEDA control unit 100.

A speed change circuit 101 in the LEDA control unit 100 has a different operational clock frequency from that of the CTL 60; therefore, the speed change circuit 101 changes the speed, i.e., temporarily stores the image data in a line memory 102 and reads the data in accordance with the operation clock of the LEDA control unit 100. Afterward, an image-area control circuit 103 controls the image size and the timing, thereby performing misalignment correction in accordance with a unit of input resolution. Furthermore, a pattern control circuit 104 performs addition of an internal pattern or performs image processing, such as a trimming operation. Then, a skew correction circuit 105 stores the data on which image processing has been performed in multiple line memories 106 for skew correction. At that time, resolution conversion, e.g., from 600 dpi to 1200 dpi, is performed, and the line memory 106 for reading is changed depending on the image position so that the skew correction operation is performed.

Here, the resolution conversion means that, if the resolution of image data is different from the LEDA resolution on the output side, an operation is performed to increase the resolution in accordance with the resolution on the output side. Then, a tone control circuit 107 performs a tone control on the data on which the resolution has been increased and on which the skew correction operation has been performed, thereby adjusting the image density. For example, the image data is converted into binary matrix. Finally, an LEDA control circuit 108 controls an LEDA 110 on the basis of the image data.

Figure 5:
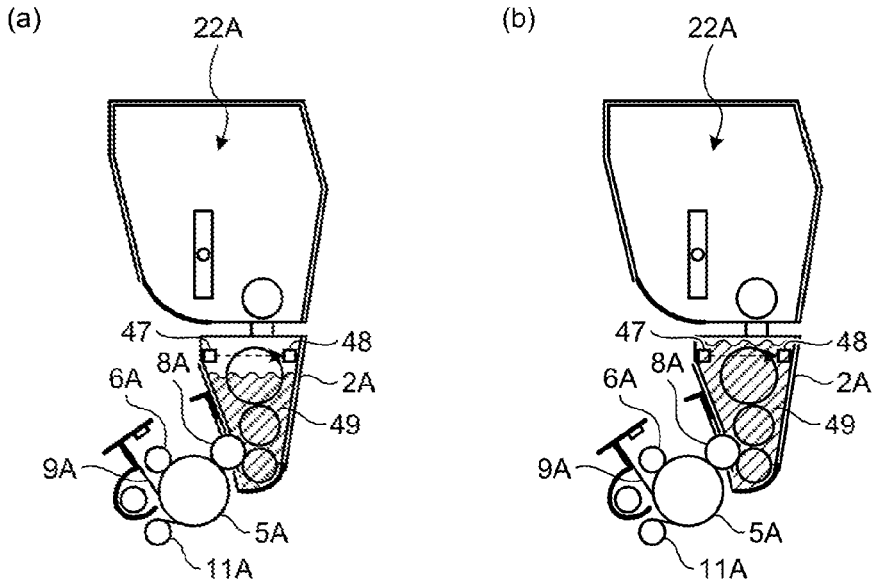
FIGS. 5(*a*) and 5(*b*) are diagrams that illustrate the detailed configuration of a developing unit according to the embodiment.
Figure 6:
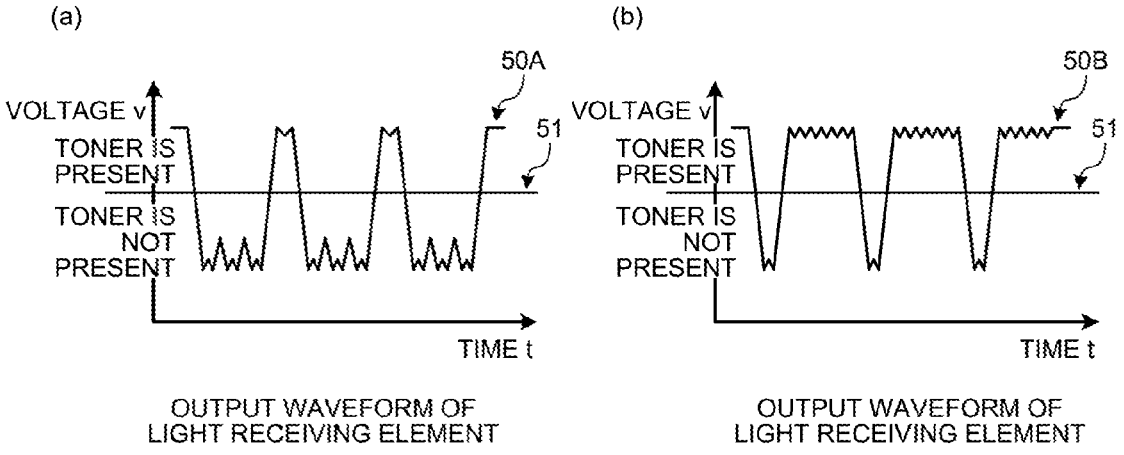
FIGS. 6(*a*) and 6(*b*) are graphs that illustrate the sampling results of the outputs from a light receiving element according to the embodiment.

Next, an explanation is given, with reference to FIGS. 5(*a*) and 5(*b*), of a configuration with which the toner detection sensors 41, 42, 43, and 44 detect the amount of residual toner in the developing units 2A, 2B, 2C, and 2D. As illustrated in FIGS. 5(*a*) and 5(*b*), a light emitting element 47 and a light receiving element 48 included in the toner detection sensors 41, 42, 43, and 44 are installed in each of the developing units 2A, 2B, 2C, and 2D, and a configuration is such that the light emitted by the light emitting element 47 passes through the inside of the developing units 2A, 2B, 2C, and 2D and is received by the light receiving element 48. With this configuration, the light is transmitted if toner 49 is not present in the optical path, and the light is blocked if the toner 49 is present in the optical path; thus, it is possible to determine whether toner 49 is present or not. Furthermore, in order to obtain a uniform concentration of degraded toner and new toner, the toner 49 in the developing units 2A, 2B, 2C, and 2D is always stirred; therefore, as illustrated in FIGS. 6(*a*) and 6(*b*), a waveform 50A or 50B can be obtained from the light receiving element 48 when the amount of toner in the developing units 2A, 2B, 2C, and 2D is large or small. Thus, it is possible to detect the presence or absence of toner regardless of the type of toner, i.e., whether toner is new or old or whether toner is magnetic or not. A threshold 51 is set with respect to the output value, and the CPU 25 (a measurement unit) determines whether there is a full amount of toner or there is no toner on the basis of the ratio of the number of times toner absence is detected to the number of times toner presence is detected.

As for the time when it is determined whether there is a full amount of toner or there is no toner, the calculated amount of toner consumption is accumulated, and the time is determined based on the value. Each time the detection result indicates that there is no toner, the amount of toner corresponding to the accumulated value of toner consumption is supplied from the toner containers 22A, 22B, 22C, and 22D. When it is detected that there is a full amount of toner, the accumulated value of toner consumption is cleared, and toner is not supplied from the toner containers 22A, 22B, 22C, and 22D.

Figure 7:
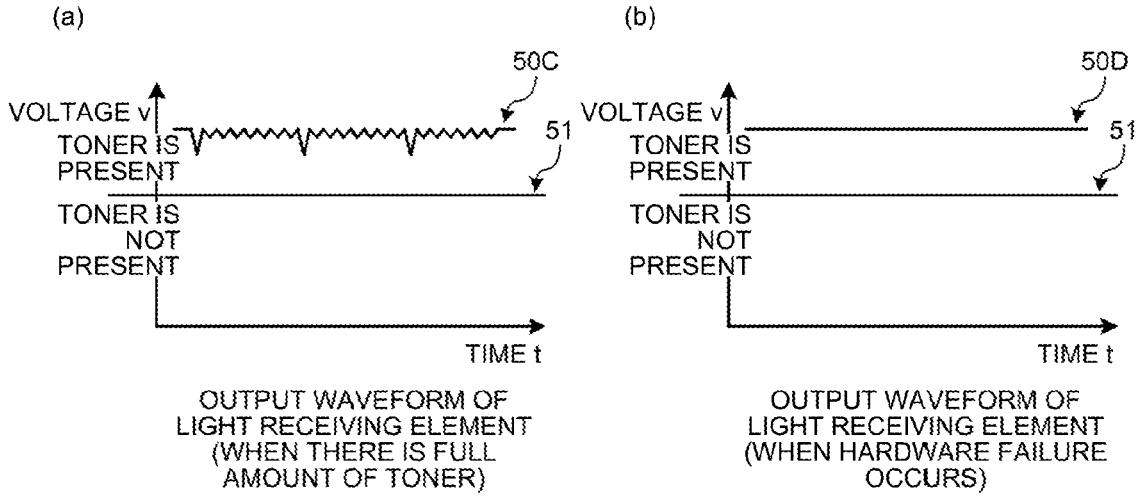
FIGS. 7(*a*) and 7(*b*) are graphs that illustrate the sampling results of outputs from the light receiving element according to the embodiment.

FIGS. 7(*a*) and 7(*b*) illustrate the amount of toner consumption when it is detected that there is a full amount of toner in the developing units 2A, 2B, 2C, and 2D. According to the toner-amount detection method that is explained with reference to FIGS. 6(*a*) and 6(*b*), when there is a full amount of toner in the developing units 2A, 2B, 2C, and 2D, the light receiving element 48 outputs a waveform 50C illustrated in FIG. 7(*a*). That is, when "toner is present" is always read from the light receiving element 48, it is detected that there is a full amount of toner. However, if the light emitting element 47 or the light receiving element 48 has an operation failure, connection failure, or a problem of an optical path, or the like, the voltage value of the light receiving element remains on the "toner is present" side, and thus a waveform 50D illustrated in FIG. 7B is output. In such a case, "tone is present" is always read. Therefore, it is difficult to determine whether the fullness is normally detected, i.e., there is really a full amount of toner in the developing units 2A, 2B, 2C, and 2D, or the fullness is falsely detected due to a failure of a detection element.

Figure 8:
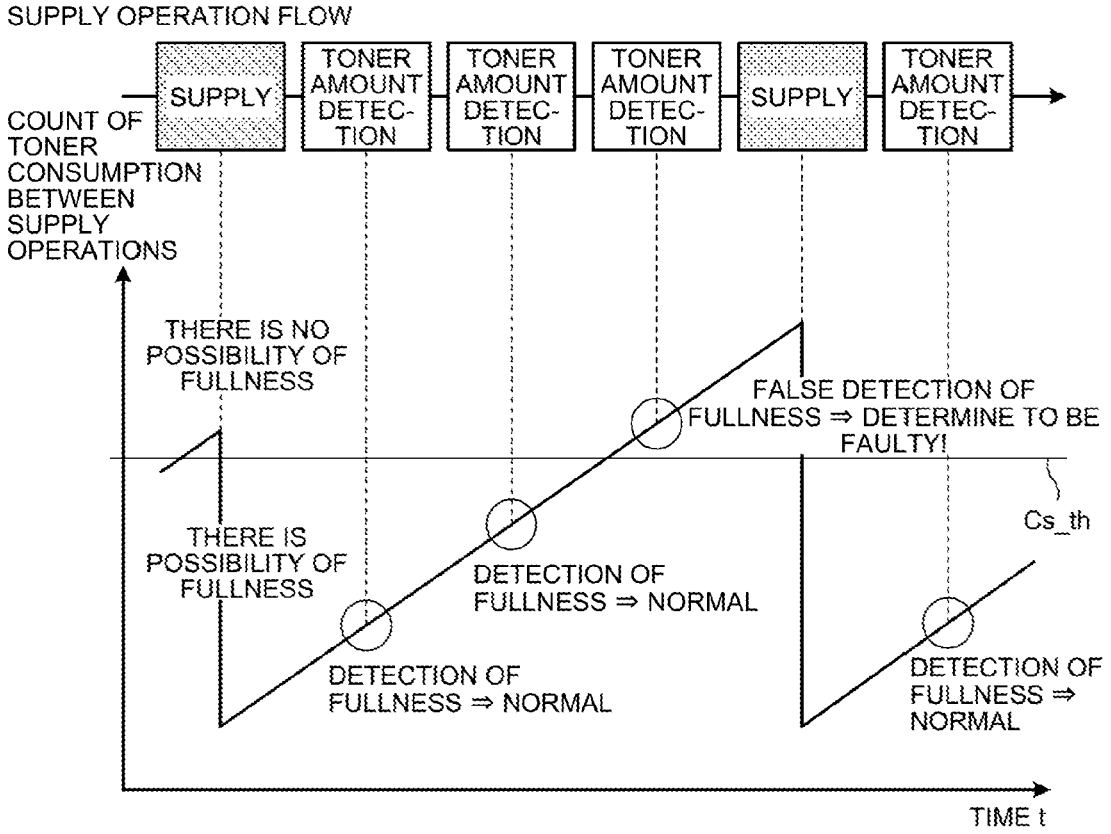
FIG. 8 is a diagram that illustrates the relation between a toner-amount detection result and the accumulated amount of toner consumption between supply operations according to the embodiment.

Thus, the accumulated amount of toner consumption during toner amount detection is used as a criterion. FIG. 8 is a diagram that illustrates changes of the accumulated value of toner consumption between a supply operation and a subsequent supply operation. As illustrated in FIG. 8, the amount of toner consumption between supply operations indicates how much toner is reduced after toner is supplied to the developing units 2A, 2B, 2C, and 2D; therefore, by referring to the accumulated value of toner consumption between supply operations during toner amount detection, it is possible to predict whether there is a possibility that the fullness is detected or there is no possibility that the fullness is detected. Thus, if the light receiving element 48 always indicates "toner is present" during toner amount detection, the CPU 25 (a fault determination unit) makes the following determinations, where the accumulated amount of toner consumption between supply operations is Cs and the toner consumption threshold between supply operations is Cs_th (a first threshold).

If Cs≤Cs_th, a full amount of toner is detected (normal).

If Cs>Cs_th, a full amount of toner is falsely detected (faulty).

Specifically, if the accumulated amount of toner consumption is larger than a predetermined threshold, the following is possible. If there is a full amount of toner in a normal way, the value Cs is reset and therefore it does not exceed the threshold. If the accumulated amount of toner consumption is increased without being reset, it is assumed that a full amount of toner is falsely detected although the amount of toner is decreased. By making this determination, it is determined whether a full amount of toner is detected or falsely detected. If it is determined to be normal, the operation of the apparatus is continued. If it is determined to be faulty, the apparatus notifies the user of a fault of the toner detection sensors 41, 42, 43, and 44 so that the apparatus is forcibly stopped. The amount of toner consumption that is needed to obtain the accumulated amount of toner consumption Cs between toner container replacements is calculated by using the method illustrated in FIG. 3. Furthermore, the toner consumption threshold Cs_th is set based on, for example, the largest amount of toner that can be contained in the developing units 2A, 2B, 2C, and 2D.

Furthermore, there is a possibility that the amount of toner supplied to the developing units 2A, 2B, 2C, and 2D becomes larger than a specified amount because of variations in the supplying mechanisms of the toner containers 22A, 22B, 22C, and 22D; therefore, when it is detected that there is a full amount of toner, there is a possibility that the toner overflows due to too much supply to the developing units 2A, 2B, 2C, and 2D. Therefore, when a full amount of toner is detected, the CPU 25 changes the value of the supply-amount correction coefficient α that is used to calculate the following supply amount so as to reduce the subsequent supply amount and then stores it in the RAM 27.

$$\text{(Toner supply amount)}=\text{(accumulated amount of toner consumption between supply operations)}\times\alpha$$

Specifically, the value of the supply-amount correction coefficient α is corrected so that it becomes a value smaller than 1; thus, even if an error occurs which increases the amount of toner consumption, it is possible to make an adjustment so as to prevent effects on supply operations. Furthermore, at that time, it is also possible that a correction is made so as to decrease the expected value of toner consumption and thus the accuracy of the toner consumption is increased.

Figure 9:
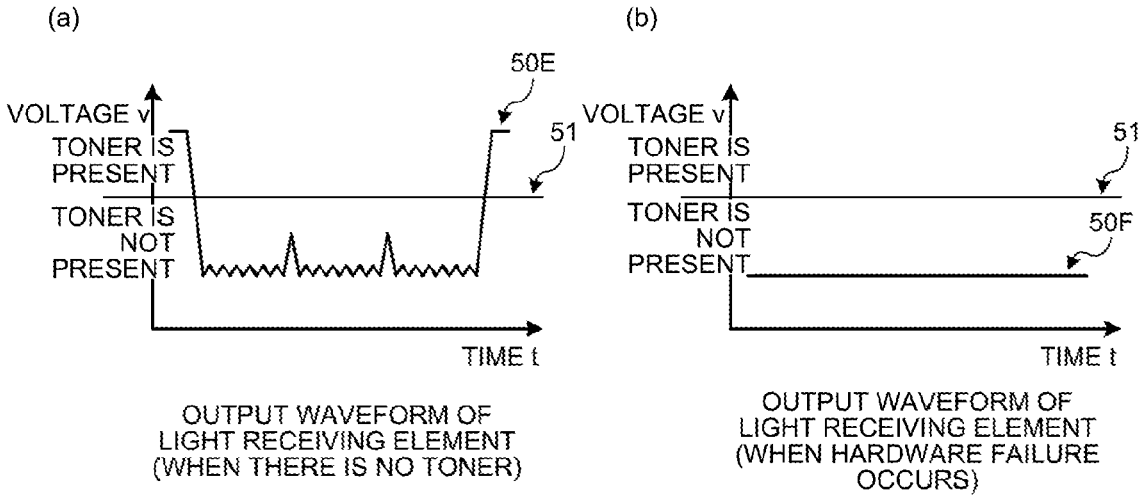
FIGS. 9(*a*) and 9(*b*) are graphs that illustrate the sampling results of outputs from the light receiving element according to the embodiment.

FIGS. 9(*a*) and 9(*b*) illustrate the toner consumption when it is detected that there is no toner in the developing units 2A, 2B, 2C, and 2D. As illustrated in FIGS. 9(*a*) and 9(*b*), when there is no toner in the developing unit 2A, the light receiving element 48 outputs a waveform 50E illustrated in FIG. 9(*a*). That is, if "toner is not present" is always read from the light receiving element 48 for a predetermined time period, the emptiness can be detected.

However, if the light emitting element 47 or the light receiving element 48 has an operation failure, connection failure, or a problem of an optical path, or the like, the voltage value of the light receiving element 48 remains on the "toner is not present" side, and thus a waveform 50F illustrated in FIG. 9(*b*) is output. In such a case, "tone is not present" is always read. Therefore, it is difficult to determine whether the emptiness is normally detected, i.e., there is really no toner in the developing units 2A, 2B, 2C, and 2D, or the emptiness is falsely detected due to a failure of the toner detection sensors 41, 42, 43, and 44.

Here, the table in FIG. 10 illustrates the combinations of the actual amount of toner in the developing units 2A, 2B, 2C, and 2D and the toner containers 22A, 22B, 22C, and 22D that can occur when it is always detected that "toner is not present" in the developing units 2A, 2B, 2C, and 2D in the following cases, i.e., in a case where a detection element is normal and in a case where the detection element is faulty and the voltage value always remains on the "toner is not present" side. As illustrated in FIG. 10, there are the six combinations, i.e., status 52*a* to status 57*a*, in total, and a different operation is performed in the apparatus depending on the statuses 52*a* to 57*a*.

The status 52*a* is a status where the developing units 2A, 2B, 2C, and 2D contain no toner and the toner containers 22A, 22B, 22C, and 22D contain toner and thus toner supply does not simply keep up with demand; therefore, the operation is continuously performed to supply toner. In the case of the statuses 53*a*, 55*a*, and 57*a*, no toner remains in the toner containers 22A, 22B, 22C, and 22D; therefore, regardless of whether the toner detection sensors 41, 42, 43, and 44 are normal or faulty, a process is performed to notify a user that the toner containers 22A, 22B, 22C, and 22D need to be replaced and to forcibly stop the operation of the apparatus.

Furthermore, in the case of the statuses 54*a* and 56*a*, if the operation of the apparatus is continuously performed to supply toner, the toner overflows from the developing units 2A, 2B, 2C, and 2D; therefore, a user is notified of a failure of the toner detection sensors 41, 42, 43, and 44, and the apparatus is forcibly stopped. However, in each of the status 52*a* and the statuses 54*a*, 56*a*, it is determined that the toner containers 22A, 22B, 22C, and 22D contain toner, and the voltage from the toner detection sensors 41, 42, 43, and 44 indicates that "toner is not present"; therefore, it is difficult to distinguish between them. Therefore, if the toner detection sensors 41, 42, 43, and 44 detect that there is no toner in the developing units 2A, 2B, 2C, and 2D and if toner remains in the toner containers 22A, 22B, 22C, and 22D, a control is performed to forcibly supply toner.

By performing the above operation, the actual status with respect to the amount of toner is changed, i.e., the status 52*a* is changed to the status 52*b*, the status 54*a* is changed to the status 54*b*, and the status 56*a* is changed to the status 56*b*. At that time, in the status 52*b*, toner is supplied to the developing units 2A, 2B, 2C, and 2D, and the toner detection sensors 41, 42, 43, and 44 are normal; therefore, the detection result does not indicate that there is no toner in the developing units 2A, 2B, 2C, and 2D. However, in the statuses 54*b* and 56*b*, although toner is supplied to the developing units 2A, 2B, 2C, and 2D, the detection result of the toner detection sensors 41, 42, 43, and 44 indicates that "toner is not present"; therefore, if the detection result of the toner detection sensors 41, 42, 43, and 44 indicates that "toner is not present" after toner is forcibly supplied, it can be determined that it is falsely detected that there is no toner during toner amount detection.

Figure 11:
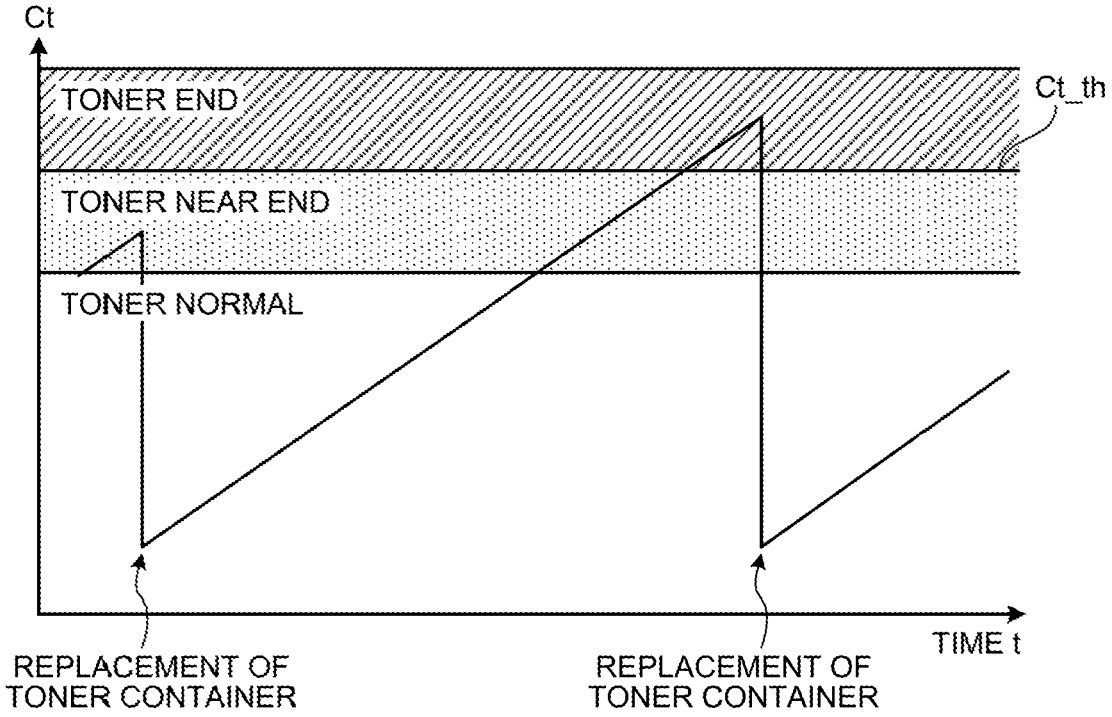
FIG. 11 is a graph that illustrates the time when the toner container is replaced according to the embodiment.

Furthermore, the presence or absence of toner that remains in the toner containers 22A, 22B, 22C, and 22D can be determined based on the accumulated amount of toner consumption. FIG. 11 illustrates the relation between the operating life of the toner container and the accumulated value of toner consumption from when the toner container is replaced with a new one until when the toner container is replaced with a subsequent one. As illustrated in FIG. 11, the accumulated amount of toner consumption between replacements of toner containers indicates the amount of toner supplied from the toner containers 22A, 22B, 22C, and 22D to the developing units 2A, 2B, 2C, and 2D; therefore, the presence or absence of toner that remains in the toner containers 22A, 22B, 22C, and 22D can be determined by using the following equation, where the accumulated amount of toner consumption between replacements of toner containers is Ct and the toner near-end consumption threshold is Ct_th (a second threshold).

If $Ct > Ct_th$, no toner remains in the toner container.

If $Ct \leq Ct_th$, toner remains in the toner container.

Here, the method that is explained with reference to FIG. 3 may be used to calculate the amount of toner consumption that is needed to calculate the accumulated amount of toner consumption Ct between replacements of the toner containers 22A, 22B, 22C, and 22D. Furthermore, if the amount of toner in the developing units 2A, 2B, 2C, and 2D is increased from zero due to the above-described forcible toner supply operation, the status can be determined to be the status 52*b*. As the status 52*b* is a status where toner has not been supplied to the developing units 2A, 2B, 2C, and 2D although toner remains in the toner containers 22A, 22B, 22C, and 22D, it may be determined that the operation to supply toner to the developing units 2A, 2B, 2C, and 2D is performed later than expected. Therefore, the CPU 25 performs an operation to change the value of the supply-amount correction coefficient $\alpha$ that is used to calculate the following supply amount and store it in the RAM 27 so as to increase the supply amount during the subsequent supply operation.

$$(\text{Toner supply amount}) = (\text{amount of toner consumption between supply operations}) \times \alpha$$

Specifically, the CPU 25 corrects the value of the supply-amount correction coefficient $\alpha$ such that it becomes a value larger than 1. Thus, the supply amount during a supply operation can be controlled with a higher accuracy. Furthermore, it may be assumed that the status 52*a* occurs because the expected value of toner consumption is smaller than expected. Instead of correcting the supply amount as described above, the expected value of toner consumption is corrected so as to become larger; thus, the amount of toner consumption can be expected with a higher accuracy.

Figure 12:
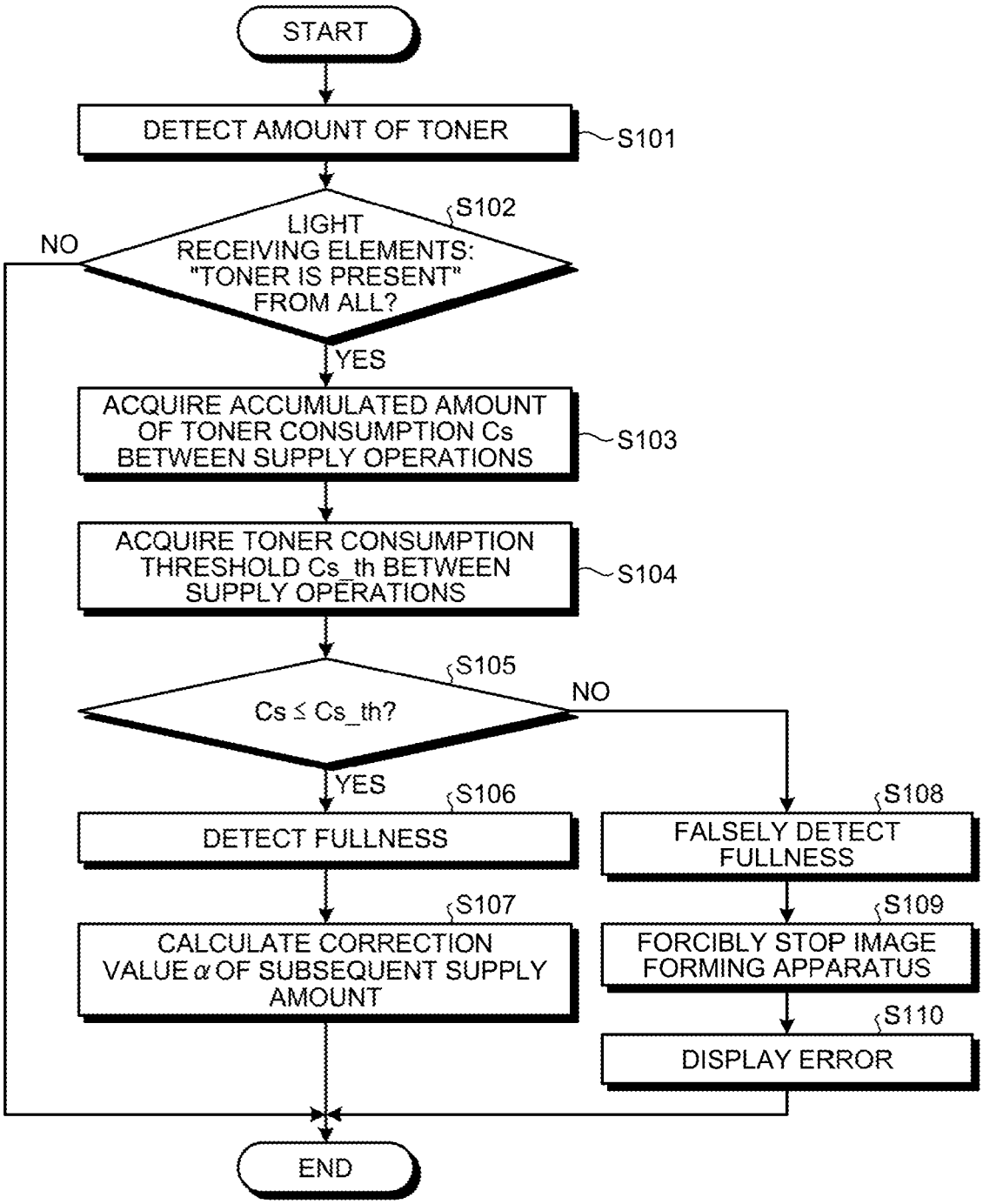
FIG. 12 is a flowchart that illustrates the flow of a process performed when it is detected that there is a full amount of toner according to the embodiment.

Next, an explanation is given, with reference to FIG. 12, of the flow of a process to determine whether a full amount of toner is detected or falsely detected during the above-described toner amount detection. This control flow is performed on each of the toner containers 22A, 22B, 22C, and 22D. As illustrated in FIG. 12, the CPU 25 first turns on the light emitting element 47 and samples the output value from the light receiving element 48, thereby performing an operation to detect the amount of toner in the developing units 2A, 2B, 2C, and 2D (Step S101). The CPU 25 then determines whether or not all of the sampled output values from the light receiving element 48 indicate "toner is present" (Step S102). When it is determined that they do not indicate "toner is present" (No at Step S102), the process is then terminated. Conversely, when it is determined that they indicate "toner is present" (Yes at Step S102), the CPU 25 acquires the accumulated amount of toner consumption Cs between supply operations, which is registered in the NVRAMs 31, 32, 33, and 34 (Step S103). The CPU 25 then acquires the toner consumption threshold Cs_th between supply operations, which is registered in the NVRAMs 31, 32, 33, and 34 (Step S104).

The CPU 25 then compares the accumulated amount of toner consumption Cs with the toner consumption threshold Cs_th so as to determine whether Cs≤Cs_th (Step S105). When it is determined that Cs≤Cs_th (Yes at Step S105), the CPU 25 determines that the toner-amount detection result indicates that "the fullness is detected" (Step S106). When the supply amount is large, the CPU 25 sets a lower supply-amount correction coefficient α so as to correct and reduce the subsequent supply amount and then stores it in the RAM 27 (Step S107).

Conversely, when it is determined that Cs>Cs_th (No at Step S105), the CPU 25 determines that the toner-amount detection result indicates that "the fullness is falsely detected", recognizes a failure of the toner detection sensors 41, 42, 43, and 44 (Step S108), and then forcibly stops the image forming apparatus 1 (Step S109). Furthermore, the CPU 25 displays an error and prompts the user to request serviceman's repair (Step S110).

Figure 13:
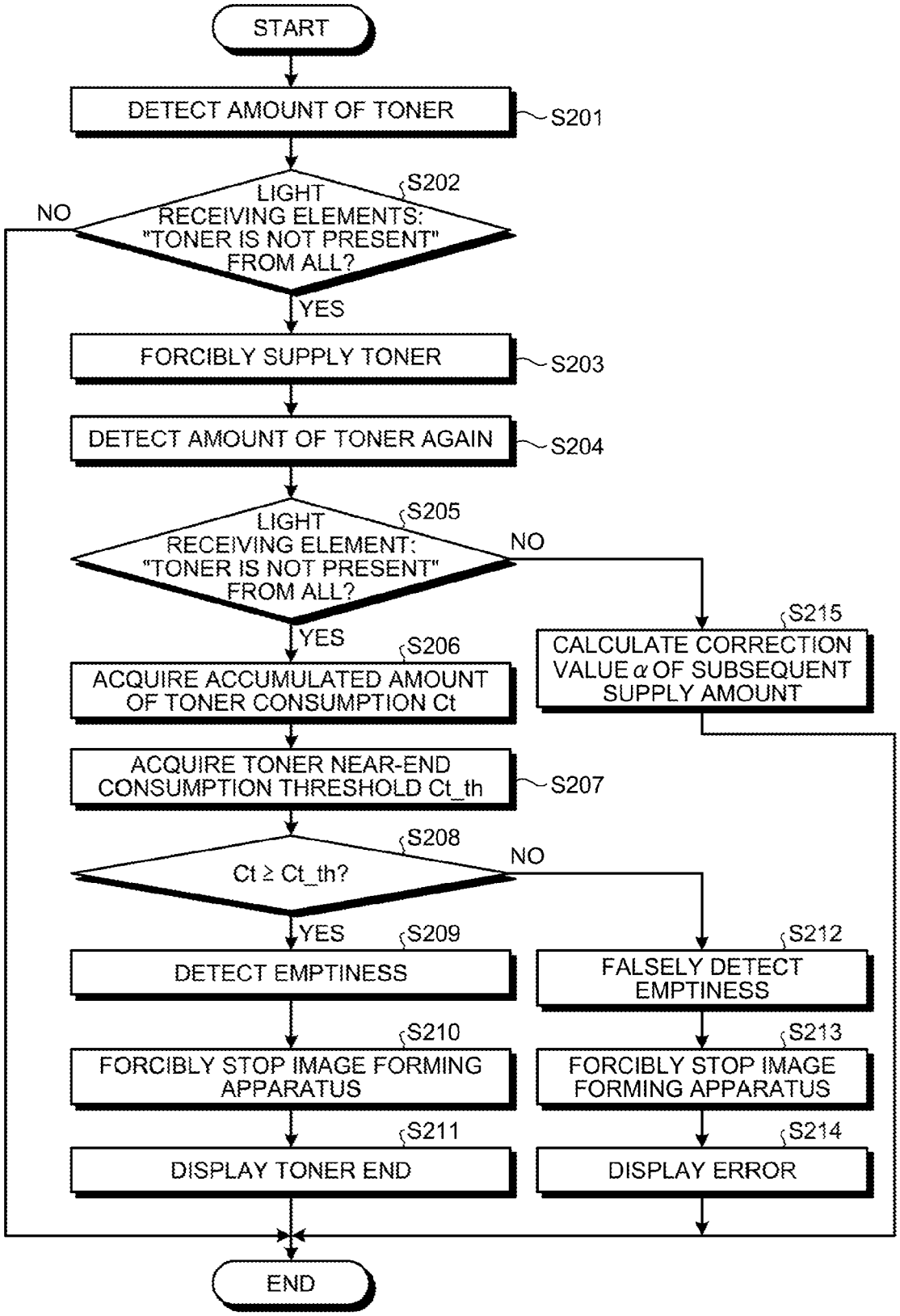
FIG. 13 is a flowchart that illustrates the flow of a process performed when it is detected that there is no toner according to the embodiment.

Next, an explanation is given, with reference to FIG. 13, of the flow of a process to determine whether it is detected that there is no toner or it is falsely detected that there is no toner during toner amount detection. This control flow is performed on each of the toner containers 22A, 22B, 22C, and 22D. The CPU 25 first turns on the light emitting element 47 and samples the output value from the light receiving element 48, thereby performing an operation to detect the amount of toner in the developing units 2A, 2B, 2C, and 2D (Step S201). The CPU 25 then determines whether or not all of the sampled output values from the light receiving element 48 indicate that "toner is not present" (Step S202). When it is determined that they do not indicate that "toner is not present" (No at Step S202), the process is then terminated. Conversely, when it is determined that they indicate that "toner is not present" (Yes at Step S202), the CPU 25 forcibly supplies toner so as to restore the developing units 2A, 2B, 2C, and 2D from a state where they run out of toner due to supply delay (Step S203). At that time, the supply amount is set to be a value based on the amount of toner consumption between supply operations so that the toner does not overflow.

The CPU 25 then turns on the light emitting element 47 again and samples the output value from the light receiving element 48, thereby performing an operation to detect the amount of toner in the developing units 2A, 2B, 2C, and 2D (Step S204). The CPU 25 then determines whether or not all of the sampled output values from the light receiving element 48 indicate that "toner is not present" (Step S205). When it is determined that they do not indicate that "toner is not present" (No at Step S205), the toner detection sensors 41, 42, 43, and 44 normally detects that toner has been supplied; therefore, it is determined that the toner supply has been delayed. Thus, the CPU 25 sets a higher supply-amount correction coefficient α so as to correct and increase the subsequent supply amount and then stores it in the RAM 27 (Step S215).

Conversely, when it is determined that all of them indicate that "toner is not present" (Yes at Step S205), the CPU 25 acquires the accumulated amount of toner consumption Ct that is registered in the NVRAMs 31, 32, 33, and 34 (Step S206). Furthermore, the CPU 25 acquires the toner near-end consumption threshold Ct_th that is registered in the NVRAMs 31, 32, 33, and 34 (Step S207). The CPU 25 then compares the accumulated amount of toner consumption Ct with the toner near-end consumption threshold Ct_th so as to determine whether Ct≥Ct_th (Step S208).

When it is determined that Ct≥Ct_th (Yes at Step S208), the CPU 25 determines that the toner-amount detection result indicates that "the emptiness is detected" and recognizes that there is no toner in the toner containers 22A, 22B, 22C, and 22D (Step S209). The CPU 25 then forcibly stops the image forming apparatus 1 (Step S210), displays a toner end, and prompts the user to replace the toner containers 22A, 22B, 22C, and 22D (Step S211).

Conversely, when it is not determined that Ct≥Ct_th (No at Step S208), the CPU 25 determines that the toner-amount detection result indicates that "the emptiness is falsely detected" and recognizes that a failure occurs in the toner detection sensors 41, 42, 43, and 44 (Step S212). The CPU 25 then forcibly stops the image forming apparatus 1 (Step S213), displays an error, and prompts the user to request serviceman's repair (Step S214).

In the image forming apparatus 1 according to the above-described embodiment, it is determined whether there is a full amount of toner in the developing units 2A, 2B, 2C, and 2D or there is no toner in the toner containers 22A, 22B, 22C, and 22D by using the amount of toner consumption that is calculated based on image data; thus, false detection as to whether there is a full amount of toner or there is no toner in the developing units 2A, 2B, 2C, and 2D can be prevented from occurring due to a failure, or the like, of the toner detection sensors 41, 42, 43, and 44.

In the above-described embodiment, an explanation is given of a case where the image forming apparatus according to the present invention is applied to a multifunction peripheral that has at least two functions out of copying, printing, scanning, and facsimile functions; however, any image forming apparatuses, such as copiers, printers, scanners, or facsimile machines, are applicable.

According to an aspect of the present invention, an advantage is produced such that it is possible to prevent false detection as to whether there is a full amount of toner in the developing unit.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising;

a developing unit configured to form an image;

a detection unit configured to detect toner in the developing unit;

a measurement unit configured to make a measurement as to whether there is a full amount of toner or there is no toner in the developing unit by using a detection history of the detection unit with regard to the toner;

a supplying unit configured to supply toner to the developing unit;

a toner-amount calculation unit configured to calculate, using image data to be printed, an amount of toner consumption that is needed during printing;

an accumulation unit configured to calculate an accumulated amount of toner consumption by accumulating the amount of toner consumption every time printing is conducted; and a fault determination unit configured to determine, based on the accumulated amount of toner consumption, whether a measurement result obtained by the measurement unit is normal or not as to whether there is a full amount of toner or there is no toner.

2. The image forming apparatus according to claim 1, wherein the fault determination unit calculates the accumulated amount of toner consumption between supply operation and a subsequent supply operation, when the measurement unit detects that there is a full amount of toner in the developing unit, and when the accumulated amount of toner consumption is smaller than a first threshold, the fault determination unit determines that the measurement result is normal, and when the measurement unit detects that there is a full amount of toner in the developing unit, and when the accumulated amount of toner consumption is larger than the first threshold, the fault determination unit determines that the measurement result is faulty.

3. The image forming apparatus. according to claim 2 wherein, when the fault determination unit determines that the measurement result is normal, the supplying unit performs correction so as to reduce a subsequent supply amount of the toner.

4. The image forming apparatus according to claim 1, wherein the detection unit includes a light emitting unit and a light receiving unit, when light is not transmitted through the space in the developing unit, the detection unit outputs a notification that the toner is present and when light is transmitted through the space in the developing unit, the detection unit outputs a notification that the toner is not present.

5. The image forming apparatus according to claim 1, wherein, when an exposure unit for forming an image is a line-type exposure unit, the toner-amount calculation unit calculates the amount of toner consumption that is needed during printing by using the image data that is obtained before skew correction is performed.

6. The image forming apparatus according to claim 1, wherein, when an exposure unit for forming an image is an exposure unit that scans, the toner-amount calculation unit calculates the amount of toner consumption that is needed during printing by using light emission data on the image data.

* * * * *